US007244219B1

(12) United States Patent
Preciado

(10) Patent No.: US 7,244,219 B1
(45) Date of Patent: Jul. 17, 2007

(54) SPARRING APPARATUS

(76) Inventor: Raymond A. Preciado, 7475 N. Camino de la Tierra, Tucson, AZ (US) 85741

( * ) Notice: Subject to any disclaimer, the term of this patent is extended or adjusted under 35 U.S.C. 154(b) by 0 days.

(21) Appl. No.: 11/035,630

(22) Filed: Jan. 14, 2005

(51) Int. Cl.
*A63B 62/24* (2006.01)
*A63B 69/34* (2006.01)
*A63B 69/20* (2006.01)

(52) U.S. Cl. ..... 482/90; 482/83; 482/86

(58) Field of Classification Search ..... 482/83–90; D21/787, 798
See application file for complete search history.

(56) References Cited

U.S. PATENT DOCUMENTS

| | | | | |
|---|---|---|---|---|
| 3,927,879 | A | 12/1975 | Long et al. | |
| 4,239,209 | A * | 12/1980 | Curchod | 482/83 |
| 4,557,478 | A | 12/1985 | Levine | |
| 4,653,746 | A | 3/1987 | Brunier | |
| 4,721,302 | A | 1/1988 | Murphy | |
| 5,046,724 | A * | 9/1991 | Sotomayer | 482/90 |
| 5,052,683 | A | 10/1991 | Wang et al. | |
| 5,256,069 | A | 10/1993 | Snowden, Jr. et al. | |
| 5,330,403 | A | 7/1994 | Kuo | |
| 5,437,590 | A | 8/1995 | D'Alto | |
| 5,458,552 | A * | 10/1995 | Mara | 482/90 |
| 5,613,925 | A * | 3/1997 | Miasserian | 482/83 |
| 5,722,920 | A * | 3/1998 | Bauer | 482/83 |
| 5,735,775 | A | 4/1998 | Miasserian | |
| 5,788,612 | A | 8/1998 | Rennick | |
| 5,800,319 | A | 9/1998 | Choate | |
| 5,899,835 | A * | 5/1999 | Puranda | 482/90 |
| 5,984,842 | A | 11/1999 | Chu | |
| 6,027,435 | A | 2/2000 | Nadorf et al. | |
| 6,090,018 | A | 7/2000 | Laudenslager et al. | |
| 6,241,640 | B1 | 6/2001 | Chu | |

FOREIGN PATENT DOCUMENTS

| | | |
|---|---|---|
| GB | 486671 | 6/1938 |
| GB | 1443017 | 7/1976 |
| GB | 2167677 | 6/1986 |
| GB | 2282762 | 4/1995 |
| WO | WO 98/42997 | 10/1998 |
| WO | WO 99/65575 | 12/1999 |
| WO | WO 02/098520 | 12/2002 |
| WO | WO 2004/012828 | 2/2004 |

* cited by examiner

*Primary Examiner*—Stephen R. Crow
*Assistant Examiner*—Allana Lewin
(74) *Attorney, Agent, or Firm*—Lawrence R. Oremland, P.C.

(57) ABSTRACT

An exercise device and sparring apparatus that includes a supporting base, a biasing mechanism coupled to, and supported vertically above, the base, a shaft attached to the biasing mechanism, and an arm member disposed in substantially perpendicular arrangement with the shaft, with the arm member further including a cushion disposed upon a punching end of the arm member.

4 Claims, 6 Drawing Sheets

SPARRING APPARATUS

BACKGROUND OF THE INVENTION

1. Field of the Invention

This invention relates generally to sporting goods that are set in motion or struck by a user during a workout and more particularly to an exercise apparatus that is especially useful in boxing or other martial arts to practice striking, timing, and evasion skills.

2. Description of the Related Art

Many martial art "targets" of various types (e.g., timing pads, punching bags, fight dummies, etc.) exist that enable a user to spar (practice striking skills associated with martial arts) or may simply be used as part of an exercise routine to expend energy. Among these, speed bags and body bags are especially well known.

For example, U.S. Pat. No. 4,653,746 by Brunier and U.S. Pat. No. 5,330,403 by Kuo both disclose punching devices that include a bag-like target area mounted to a tube and spring. The main advantage of these and similar inventions is to provide portability and adjustability to the basic punching bag. In that respect, both inventions do provide a convenient apparatus for striking. However, neither provides much opportunity to a user to anticipate counter movements or to practice evasion skills. Indeed, the return movement provided by each of these devices simply shortens the distance between the user and the target area without any simulation of a return blow.

More elaborate embodiments of the classic punching bag have evolved into "training dummies" and similar devices that feature anthropomorphic forms with specialized hitting surfaces and "arms" for simulating the delivery of a punch or the location of an opponent's hands. For example, U.S. Pat. No. 5,256,069 by Snowden, Jr. et al. discloses a boxing dummy apparatus featuring a torso, head, and appendages that are hit by a user. However, the torso and appendages of Snowden, Jr. et al.'s apparatus are static such that a user receives little if any stimulus to practice upper body evasion movements or footwork. Moreover, U.S. Pat. No. 5,052,683 by Wang et al. discloses a boxing training device with electronically controlled extendable arms.

While Wang et al.'s device may be suitable for its particular purpose, it is also relatively complicated, expensive, does not move toward an user to simulate a "charging counterattack," and does not respond to the force of a user's blow, but, rather, punches in a predetermined sequence according to a program stored in the device's memory. In the inventor's experience, a training device that "punches" according to a programmed sequence may not provide a good simulation for the typical "action and reaction" experienced when a blow is landed during a fight between human opponents.

Thus, there remains a need in the art for an exercise device and sparring apparatus that mimics the "reaction punch" and counter movement of a sparring opponent, and that is less complex and economical compared with typical boxing dummies.

SUMMARY OF THE INVENTION

The invention relates in general to an exercise and sparring apparatus that allows a user to practice punching and kicking movements, evasion techniques, and footwork. In one embodiment of the invention, the apparatus includes a base, a biasing means (such as a spring) that is coupled to, and supported vertically above, the base, a shaft attached to the biasing means and extending upwardly therefrom, and an arm member disposed in substantially perpendicular arrangement with the shaft, with the arm member including a cushion disposed upon a punching end of the arm member. By pushing or pulling the shaft in a direction opposite to that of the punching end of the arm member, the user may focus upon footwork and upper body evasion techniques by avoiding being struck by the cushion.

In another embodiment, the invention further includes a striking area disposed below the arm member and upon the shaft of the invention. The striking area faces in the same direction as the punching end of the arm member so that the user must anticipate a "return blow" in reaction to hitting or kicking the striking area, thereby allowing the integration of timing, footwork, accuracy, and anticipation and evasion of body movement and counter blows into one exercise or training routine with a single apparatus.

In a third embodiment, the striking area is disposed at an angle of between 10-60 degrees relative to the shaft so that the striking force of a user is partially dissipated, resulting in a less pronounced, and, therefore, more realistic return jab or punch by the apparatus of the invention. The angled striking area also provides a target of varying distance such that the user may adjust distance and timing accordingly.

A fourth embodiment of the invention includes a shaft that is perpendicularly attached to a base, a striking area, and an arm member, with the shaft coupled to a biasing means disposed along the shaft beneath the striking area such that delivering a blow to the striking area results in the displacement of the shaft above the biasing means, which further results in the arm member providing a return blow as urged by the biasing means.

Various other purposes and advantages of the invention will become clear from its description in the specification that follows. Therefore, to the accomplishment of the objectives described above, this invention includes the features hereinafter fully described in the detailed description of the preferred embodiments, and particularly pointed out in the claims. However, such description discloses only some of the various ways in which the invention may be practiced.

DETAILED DESCRIPTION OF THE PREFERRED EMBODIMENTS

The invention generally relates to an exercise device that includes a supporting base, a biasing means coupled to, and supported vertically above, the base, a shaft attached to the biasing means and extending upwardly therefrom, and an arm member disposed in substantially perpendicular arrangement with the shaft, with the arm member further including a cushion disposed upon a "punching end" of the arm member.

During use, the invention is set in motion by displacement of the shaft. This displacement of the shaft is counteracted by the biasing means such that the shaft (and attached arm member) is urged in a direction generally opposite to that of said displacement, with the result being that a user standing in front of the "punching end" of the arm member must evade the cushion before being struck. In this manner, the user interacts with the invention to accomplish exercise, practice footwork, and develop evasion skills. The user may also practice "shadow boxing," i.e., punch at the air while evading the arm member of the invention.

In other embodiments of the invention, the shaft includes a striking area so that a user may displace the shaft by hitting the area. Thus, the user may practice and coordinate footwork, evasion skills, and blow delivery all at once. Moreover, because there is often a tendency to counterattack as soon as possible in response to an opponent's moves in an actual fight, the invention also teaches a user to anticipate an opponent's body movement and to avoid counterblows.

Figure 1:
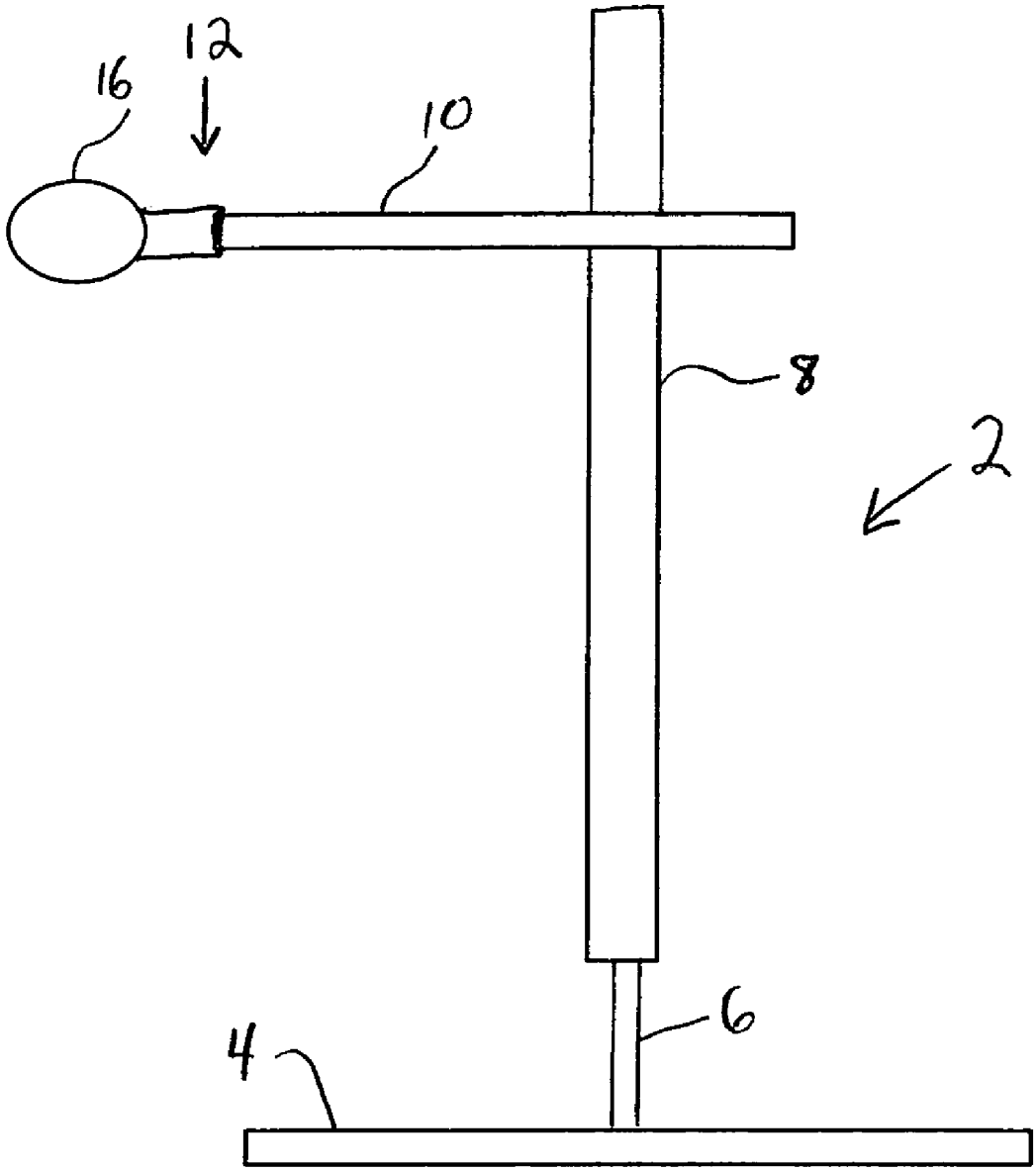
FIG. 1 schematically depicts a first embodiment of the invention in elevational side view.

Turning to the figures, wherein like numerals indicate like elements, FIG. 1 illustrates an elevational side view of a first embodiment of the invention. The apparatus for sparring 2 includes a supporting base 4 upon which a biasing means 6 is vertically disposed. Coupled to the biasing means 6 is a vertical shaft 8 upon which an arm member 10 is disposed in a position that is substantially perpendicular to the shaft 8. The arm member 10 is set at a height that approximates the upper chest to top of head level of the user and may be fixed or vertically adjustable (using, for example, a slide or collar clamp, which is not shown) along the shaft 8. Included on the punching end 12 of the arm member 10 is a cushion 16.

The base 4 preferably is designed such that the likelihood of the apparatus 2 tipping during use is minimized. Thus, constructing the base of a relatively heavy material (such as steel) is advantageous in this regard. The biasing means 6 may be any suitably rigid yet flexible material that urges the shaft 8 in a direction opposite to that of which the shaft is displaced. Accordingly, for example, a resilient polymer joint or a spring that couples the base 4 to the shaft 8 can be utilized.

Figure 2:
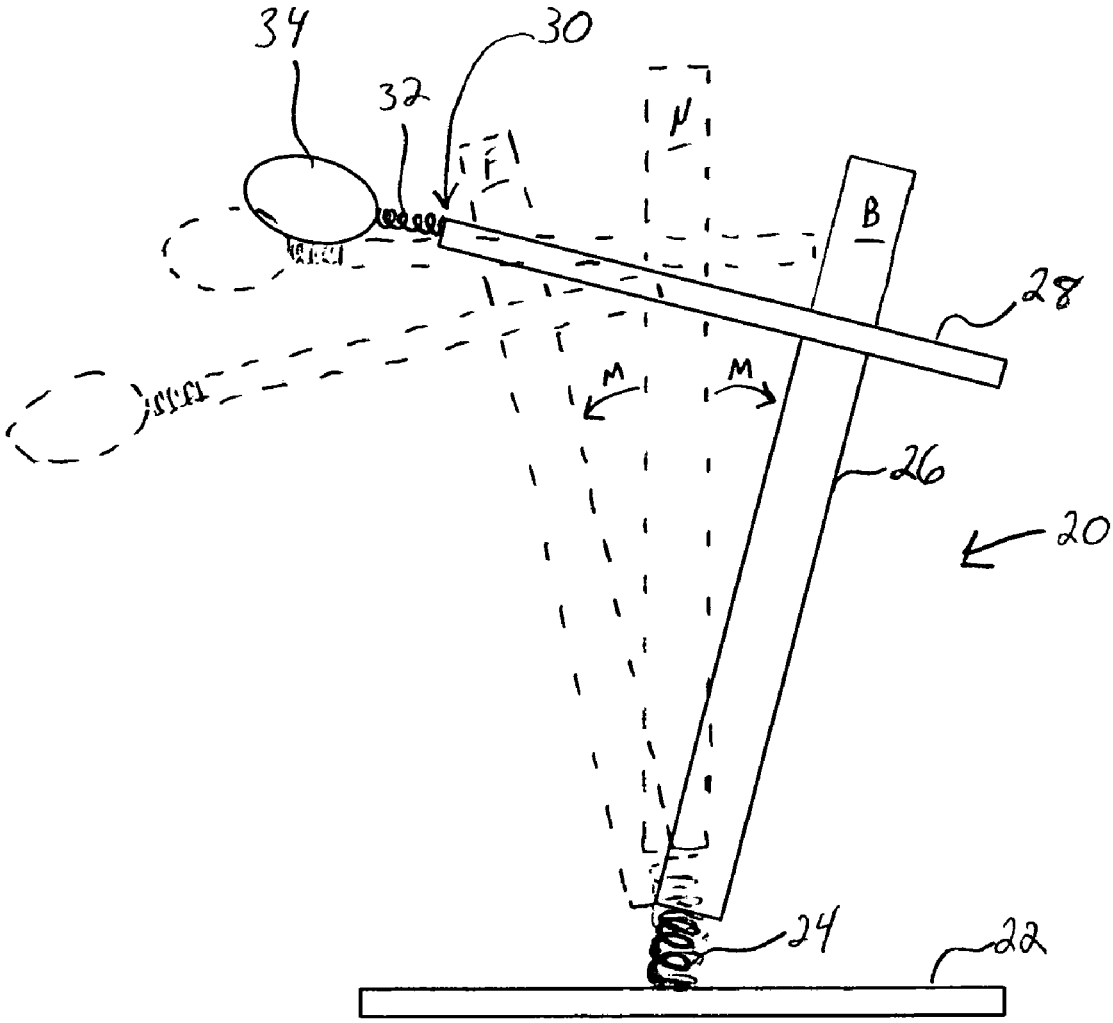
FIG. 2 schematically illustrates a second embodiment of the invention in elevational side view and depicts in phantom line an example of motion of the invention in reaction to force applied by a user.

Turning to FIG. 2, a second apparatus 20 of the invention is shown in side view at different positions in response to being set in motion (arrows M) by a user. The apparatus 20 includes a base 22 upon which a biasing means (in this case, spring 24) is vertically disposed. Coupled to spring 24 is shaft 26, which includes an arm member 28 that is disposed substantially horizontally thereon. At the punching end 30 of arm member 28 is an elastic member 32 (also a spring in this case) coupled to cushion 34.

The elastic member 32 may be a rigid but flexible material, such as rubber, that is designed to give or deform so that the full impact of the cushion 34 is mitigated. Preferably, the elastic member 32 is a coil spring capable of compressing with the force of an impact to a user by the cushion 34. In this manner, a "counter blow" may be delivered that is thought provide a more realistic feel while still providing a measure of impact absorption by the spring.

Initially, apparatus 20 is in a neutral position N. In response to force input by a user, the apparatus 20 is pushed (or pulled) to a back position B, whereupon bias means 24 urges shaft 26 towards a forward position F (presumably where a user will be standing) before urging the shaft back toward position N. These movements repeat and dissipate in proportion to the energy input by a user.

Figure 3:
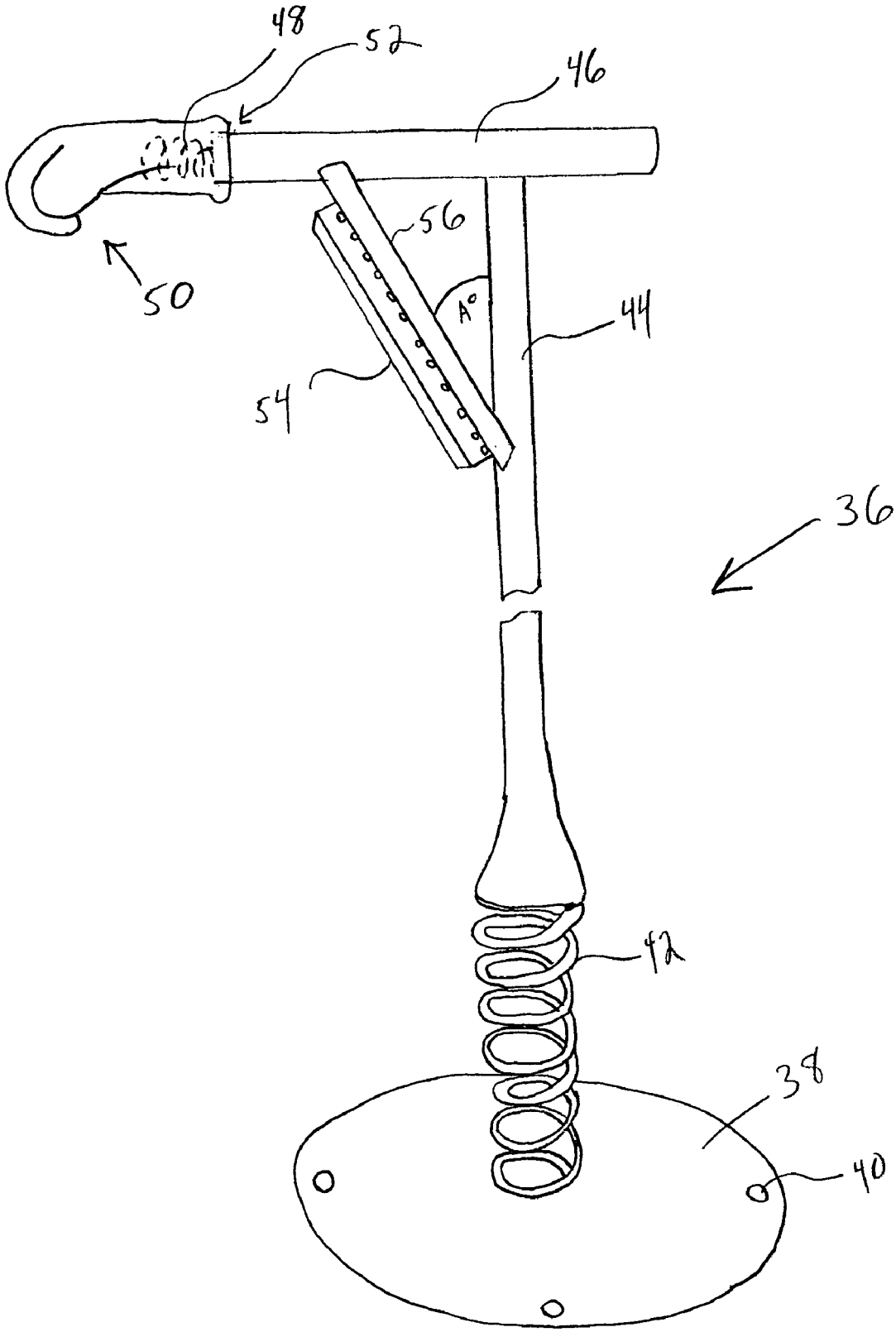
FIG. 3 depicts a third embodiment of the invention in perspective view.

As shown in FIG. 3, a third embodiment of the invention, apparatus 36, features a base 38 configured as a disc that is attachable to a ground surface with bolts (not shown) disposed through openings 40. A heavy duty spring 42 couples base 38 with shaft 44. Attached at the top of shaft 44 is arm member 46, upon which elastic member (in this case, compression spring 48) and a cushion (glove 50) are disposed upon the punching end 52 of arm member 46. A striking area 54 is positioned at an angle A of preferably between 10-60 degrees on a backing 56 between arm member 46 and shaft 44. Positioning the striking area 54 at an angle provides a striking target of varied distance and partially dissipates the energy of an incoming blow, which allows for stronger users to strike harder without causing the apparatus 36 to swing "wildly."

Because the arm member 46 "bows" during movement toward the user (as illustrated by position F in FIG. 2), the length of the arm is preferably about 30 inches to allow a user to connect with the striking area 54 while anticipating a "counter punch" in the approximate vicinity of the user's face or upper body. Similarly, the height of the arm member 46 from the ground should be a function of the user's height, with the arm member ideally being fixed at a height between a user's neck to the top of the head-level when the apparatus is in a neutral position.

Figure 4:
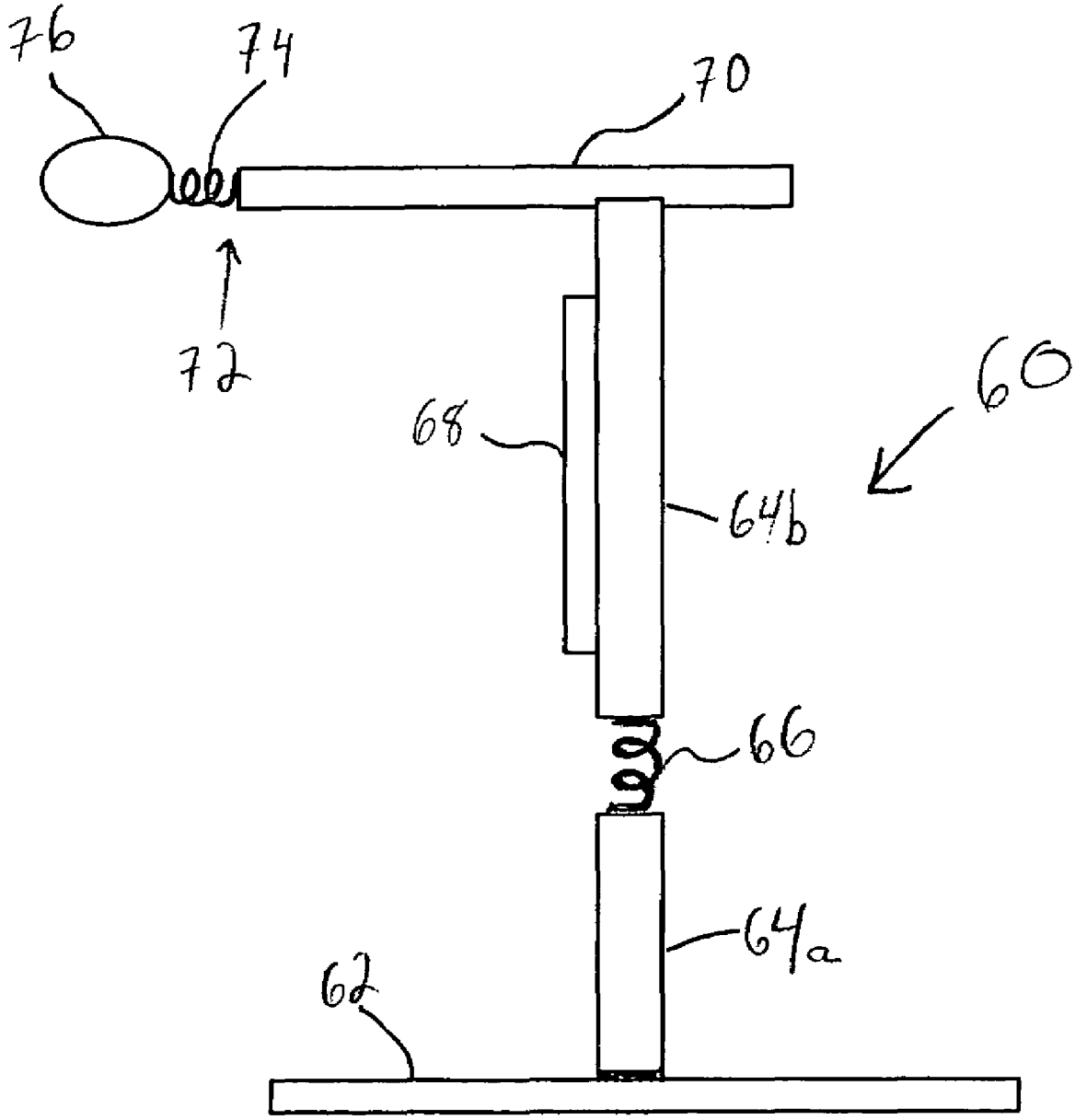
FIG. 4 schematically illustrates a fourth embodiment of the invention in elevational side view.

FIG. 4 illustrates in schematic side view a fourth embodiment of the invention, apparatus 60, having a base 62. Extending vertically from base 62 is shaft 64*a* and 64*b*, which are coupled by bias means 66. Shaft 64*b* has a striking area 68 disposed in alignment therewith. Attached to the top of shaft 64*b* is arm member 70, which includes a punching end 72 upon which elastic member 74 and a cushion 76 are present. Preferably, base 62 and shaft 64*a* are composed of stiffer and heavier material (such as steel) than shaft 64*b* and arm member 70 (which, preferably, are lightweight hard plastic). Because the development of motor coordination and basic movement skills is more important than simulating a sparring partner in some cases, this embodiment is especially suitable for use by children because it is designed to deliver a much softer "counter punch." Moreover, its lighter top half makes it very difficult to tip.

Figure 5:
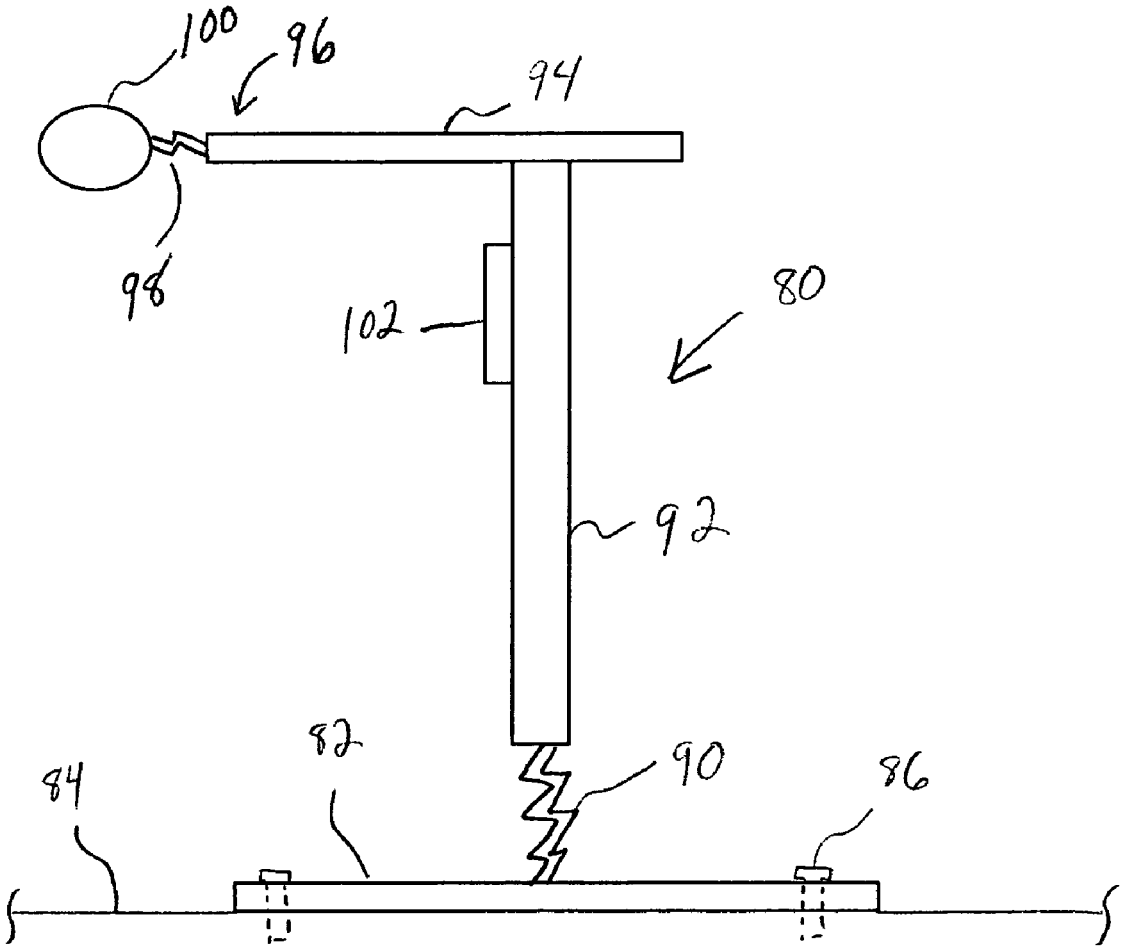
FIG. 5 schematically illustrates a fifth embodiment of the invention in elevational side view.
Figure 6:
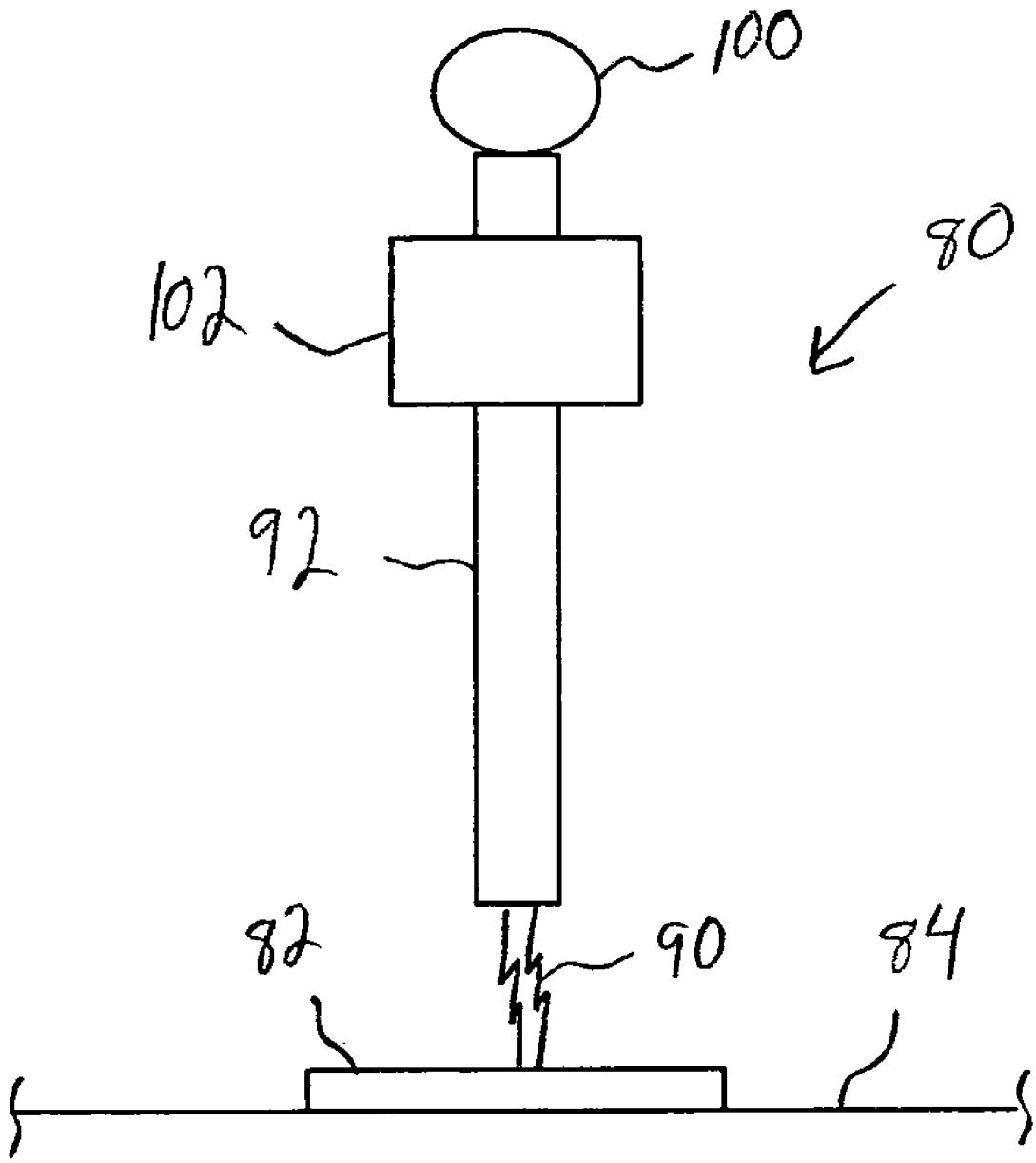
FIG. 6 depicts the embodiment of FIG. 5 in elevational front view.

Turning to FIGS. 5 and 6, apparatus 80 features a supporting base 82 secured to the ground 84 by bolts 86. Biasing means 90 couples the base 82 to shaft 92. Disposed at the top of shaft 92, and in substantially perpendicular arrangement therewith, is arm member 94. At the punching end 96 of arm member 94 is elastic member 98 and cushion 100. A striking area 102 is disposed along shaft 92 such that it faces the same direction as punching end 96.

In view of the disclosure above, it is readily seen that the invention is especially useful for practicing the integration of evasion techniques, timing, footwork, kicking and punching skills.

Various changes in the details and components that have been described may be made by those skilled in the art within the principles and scope of the invention herein described in the specification and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

What is claimed is:

1. An exercise apparatus for training a boxing trainee, comprising:

a base;

a biasing means coupled to, and supported above, the base;

a shaft attached to the biasing means and extending upwardly therefrom;

a single arm connected with the shaft and extending in a single predetermined direction from the shaft, the single arm having a striking member at an end of the arm; and a target member with a striking surface facing in the predetermined direction of the single arm and the striking member, and in an orientation relative to the single arm such that a properly thrown punch against the striking surface will cause the single arm to rock substantially backward, and the biasing means will cause the arm to then rock forward, to simulate a return punch being thrown at the trainee, in a direction that forces the trainee to avoid the return punch, and the striking surface of the target member moving toward the trainee with the simulated return punch thrown by the arm, and in an orientation that invites a properly thrown subsequent punch against the striking area;

wherein the striking surface of the target member is connected at an angle to said arm and said shaft, wherein the striking surface faces at least partially downwardly in the same general direction as the striking member at the end of said arm;

whereby displacement of the shaft is counteracted by the biasing means such that the arm member is urged in a direction opposite to that of said displacement.

2. The exercise apparatus of claim 1, wherein said striking area is disposed between said arm and said shaft at an angle between 10 and 60 degrees relative to said shaft.

3. An exercise apparatus for training a boxing trainee, consisting essentially of:

a base;

a biasing means coupled to, and supported above, the base;

a shaft attached to the biasing means and extending upwardly therefrom;

a single arm connected with the shaft and extending in a single predetermined direction from the shaft, the single arm having a striking member at an end of the arm; and a target member with a striking surface facing in the predetermined direction of the single arm and the striking member, and in an orientation relative to the single arm such that a properly thrown punch against the striking surface will cause the single arm to rock substantially backward, and the biasing means will cause the arm to then rock forward, to simulate a return punch being thrown at the trainee, in a direction that forces the trainee to avoid the return punch, and the striking surface of the target member moving toward the trainee with the simulated return punch thrown by the arm, and in an orientation that invites a properly thrown subsequent punch against the striking area; wherein the striking surface of the target member is connected at an angle to said arm and said shaft, wherein a front surface of the striking surface faces at least partially downwardly in the same general direction as the striking member at the end of said arm;

whereby displacement of the shaft is counteracted by the biasing means such that the arm member is urged in a direction opposite to that of said displacement.

4. The sparring apparatus of claim 3, wherein said striking area is disposed between said arm and said shaft at an angle between 10 and 60 degrees relative to said shaft.

* * * * *